US006923229B2

(12) United States Patent
Beckley

(10) Patent No.: US 6,923,229 B2
(45) Date of Patent: Aug. 2, 2005

(54) WALLET FOR RETAINING A PLURALITY OF CREDIT CARDS

(76) Inventor: Alan Beckley, 937 Lombardy Dr., Plano, TX (US) 75023

( * ) Notice: Subject to any disclaimer, the term of this patent is extended or adjusted under 35 U.S.C. 154(b) by 40 days.

(21) Appl. No.: 10/305,203

(22) Filed: Nov. 26, 2002

(65) Prior Publication Data

US 2004/0099357 A1 May 27, 2004

(51) Int. Cl.[7] ..... A45C 1/06
(52) U.S. Cl. ..... 150/138; 150/144
(58) Field of Search ..... 150/121, 132, 150/138.145, 147–149, 133, 137, 138, 145, 131; 40/771

(56) References Cited

U.S. PATENT DOCUMENTS

| | | | | |
|---|---|---|---|---|
| 1,772,891 A | | 8/1930 | Gardner, Jr. | |
| 1,782,003 A | * | 11/1930 | Barnett | 150/132 |
| 1,821,379 A | * | 9/1931 | Barnett | 150/132 |
| 1,895,782 A | * | 1/1933 | Buxton | 150/138 |
| 2,451,122 A | * | 10/1948 | Sherwood | 150/138 |
| 2,767,756 A | * | 10/1956 | Niles | 150/147 |
| 2,828,790 A | * | 4/1958 | Osher | 150/147 |
| 2,839,114 A | * | 6/1958 | Moscowitz et al. | 150/138 |
| 2,926,714 A | * | 3/1960 | Osher | 150/147 |
| 2,982,322 A | * | 5/1961 | Seitz | 150/147 |
| 3,187,795 A | * | 6/1965 | Stephenson | 150/147 |
| 3,299,929 A | * | 1/1967 | Shagin et al. | 150/147 |
| 3,334,677 A | * | 8/1967 | Toomey | 150/149 |
| 3,433,279 A | | 3/1969 | Seamon | 150/39 |
| 3,446,260 A | * | 5/1969 | Osher | 150/147 |
| 3,470,931 A | * | 10/1969 | Kery | 150/145 |
| 3,565,148 A | * | 2/1971 | Miller | 150/147 |
| 3,759,305 A | * | 9/1973 | McIntyre | 150/149 |
| 3,946,781 A | * | 3/1976 | Reis | 150/143 |
| 5,288,942 A | * | 2/1994 | Godfrey | 174/35 R |
| 5,431,207 A | * | 7/1995 | Siegel | 150/139 |
| 5,778,954 A | * | 7/1998 | Sullivan et al. | 150/143 |
| 6,050,311 A | | 4/2000 | Obenski | 150/139 |
| 6,105,298 A | | 8/2000 | Grayson et al. | 40/776 |

FOREIGN PATENT DOCUMENTS

| | | | | |
|---|---|---|---|---|
| DE | 2900745 A1 | * | 7/1980 | 150/147 |
| JP | 406113913 A | * | 4/1994 | 150/147 |

* cited by examiner

*Primary Examiner*—Sue A. Weaver
(74) *Attorney, Agent, or Firm*—Michael L. Diaz

(57) ABSTRACT

A wallet for retaining a plurality of cards. The wallet includes a wallet casing having two slit openings. The wallet also includes an insert which is removably attached to the wallet casing. The insert includes several pages aligned in a photo album fashion. Each page may hold at least two cards in a vertical orientation. In addition, the insert includes two insert tabs. Each tab is inserted within a slit opening. The wallet casing may include a privacy flap to cover the insert.

22 Claims, 4 Drawing Sheets

WALLET FOR RETAINING A PLURALITY OF CREDIT CARDS

BACKGROUND OF THE INVENTION

1. Technical Field of the Invention

This invention relates to wallets, and more particularly, to a wallet configured to retain a plurality of credits cards in a compact area.

2. Description of Related Art

Conventional wallets have been used for well over a century. Many years ago, the primary purpose of a wallet was to hold currency, namely a plurality of bills. As the years have gone by, the wallet has been transformed into a retainer of credit cards, identification cards, and business cards. The use of hard currency has been reduced and replaced by the use of credit cards. Although the function of the wallet has changed, the size, shape and configuration of the conventional wallet has stayed the same. Conventional wallets are merely designed to carry a lot of currency bills with only a few cards. These conventional wallets may hold only a maximum of ten cards in either tight fitting leather pockets or in plastic pockets.

Conventional wallets typically fall into two categories, the bi-fold and the tri-fold. With either type of wallet, the cards held in the pockets of the wallet are overlapped one on top of the other in horizontal pockets (turned laterally). This configuration results in wallets having a thickness of two inches or more, even when carrying a moderate number of cards.

Because of the thickness and unwieldiness of the conventional wallets, the user must be resigned to a large bulge in the back pocket or simply carrying the wallet to avoid carrying such a thick object in pockets.

Although there are no known prior art teachings of a device such as that disclosed herein, prior art references that discuss subject matter that bears some relation to matters discussed herein are U.S. Pat. No. 1,772,891 to Gardner (Gardner), U.S. Pat. No. 3,433,279 to Seamon (Seamon), U.S. Pat. No. 6,050,311 to Obenski (Obenski), and U.S. Pat. No. 6,105,298 to Grayson et al. (Grayson).

Gardner discloses a billfold designed and adapted to specially carry receiving currency of "recent" issue, which has a short length and width as compared to the former issue. Gardner's wallet includes a retaining pocket for holding the bills with an accordion style opening. However, Gardner does not teach or suggest the carriage of a plurality of cards (e.g., credit cards) in a thin configuration.

Seamon discloses a wallet having a foldable multi-card holder. The holder is an overlapping plastic insert holding several credit cards. However, Seamon merely discloses the stacking of credit cards, one on top of another. This configuration suffers from the disadvantage of creating a thick wallet. In addition, it is difficult to remove a specified card from its pocket.

Obenski discloses a billfold and credit card carrier which includes a pair of nested pockets shaped and dimensioned to hold adjacent stacks of banknotes, and a series of credit card-sized pockets for holding credit cards, a driver's license and like items. However, Obenski does not teach or suggest a side by side layout in an album configuration. Obenski merely discloses a side by side layout of cards. Obenski suffers from the disadvantage of requiring the unfolding of the wallet to retrieve a credit card. Obenski is complicated and difficult to retrieve specific cards retained within the carrier.

Grayson discloses a removable insert which is used to frame and protect photographs and the like for use in conventional wallets. Grayson merely discloses a retainer for photographs. Grayson does not teach or suggest a wallet for retaining credit cards in a thin configuration which allows easy access to the cards and currency retained within the wallet.

A wallet is needed which carries a large number of credit cards in a compact configuration while allowing quick and simple access to the cards retained in the wallet. Review of the foregoing references reveals no disclosure or suggestion of such a wallet. Thus, it would be a distinct advantage to have a wallet which may retain a plurality of credit cards in a "thin" configuration in a side by side layout and photo album fashion. It is an object of the present invention to provide such a device.

SUMMARY OF THE INVENTION

In one aspect, the present invention is a wallet for retaining a plurality of cards. The wallet includes a wallet case having a lateral opening running a substantial length of the wallet case. The lateral opening leads to an interior of the wallet case for retaining currency bills. The wallet also includes an insert affixed to the wallet case. The insert has a plurality of pages. Each page has at least two pockets, each pocket sized and shaped to retain at least one card.

In another aspect, the present invention is a wallet for retaining a plurality of cards. The wallet includes a wallet case having a slit opening and a detachable insert affixed to the wallet case. The insert has a plurality of pages, each page having at least two pockets. Each pocket is sized and shaped to retain at least one card. The pockets are configured to hold cards in a substantially vertical orientation. The plurality of pages are arranged in photo album fashion. In addition, the insert includes at least one insert tab which is positioned within the slit opening of the wallet casing to retain the insert within the wallet casing. The insert is used to retain a plurality of cards.

In still another aspect, the present invention is a wallet for retaining a plurality of cards. The wallet includes a wallet case having a lateral opening running a substantial length of the wallet case. The lateral opening leads to an interior of the wallet case. The wallet case also includes a slit opening. Additionally, the wallet includes a detachable insert affixed to the wallet case. The insert includes a plurality of pages, each page having at least two pockets. Each pocket is sized and shaped to retain at least one card. The pockets are configured to hold cards in a substantially horizontal orientation. The plurality of pages are arranged in photo album fashion. The insert also includes at least one insert tab, the insert tab being positioned within the slit opening of the wallet casing to retain the insert within the wallet casing. The insert is used to retain a plurality of cards.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
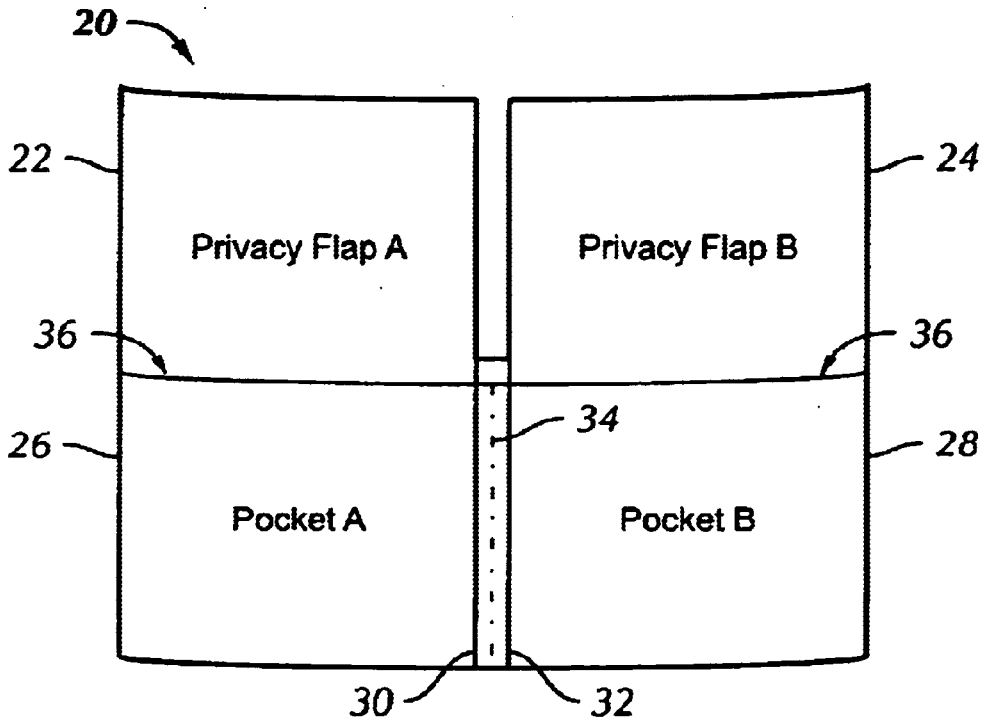
FIG. 1 is a front view of a wallet with open privacy flaps in the preferred embodiment of the present invention.
Figure 7:
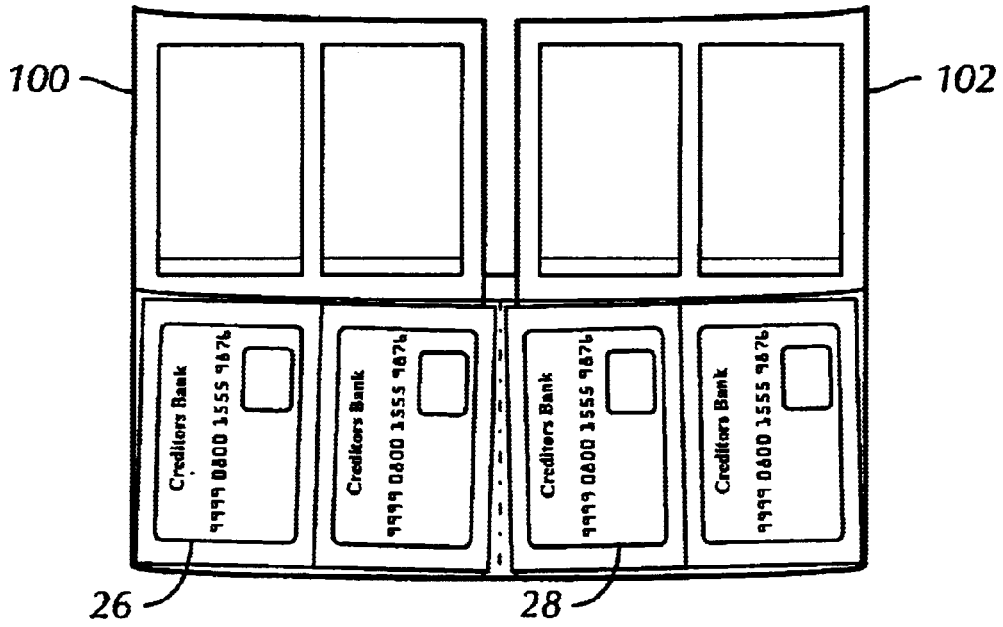
FIG. 7 is a front view of the wallet showing transparent privacy flaps.

A wallet for holding a plurality of credit cards and currency in a side by side layout is disclosed. FIG. 1 is a front view of a wallet 20 with privacy flaps 22 and 24 configured in an open position in the preferred embodiment of the present invention. The wallet includes a pocket 26 and a pocket 28. Additionally, each pocket includes a slit opening 30 and 32 located about a center axis 34. As illustrated, the privacy flaps are opened upwardly and mounted to an upper portion 36 of the wallet. The wallet is preferably constructed of a leather or simulated leather material. However, any material may be utilized which provides a support for retaining a plurality of credit cards and currency bills. To accommodate conventional sizes of credit cards, the wallet is preferably sized with dimensions of approximately 4 inches by 10.5 inches. However, it should be understood that any size of wallet maybe utilized and still be within the scope of the present invention. Each privacy flap is preferably non-transparent or nearly non-transparent to provide privacy of the retained cards held within the wallet. FIG. 7 illustrates the wallet having transparent flaps 100 and 102. However, the privacy flap may be transparent in alternate embodiments. In addition, although the privacy flaps are mounted to the top portion of the wallet, the flaps may be affixed on any portion of the wallet. Additionally, the flaps are optional and may not be present in alternate embodiments of the present invention.

Figure 2:
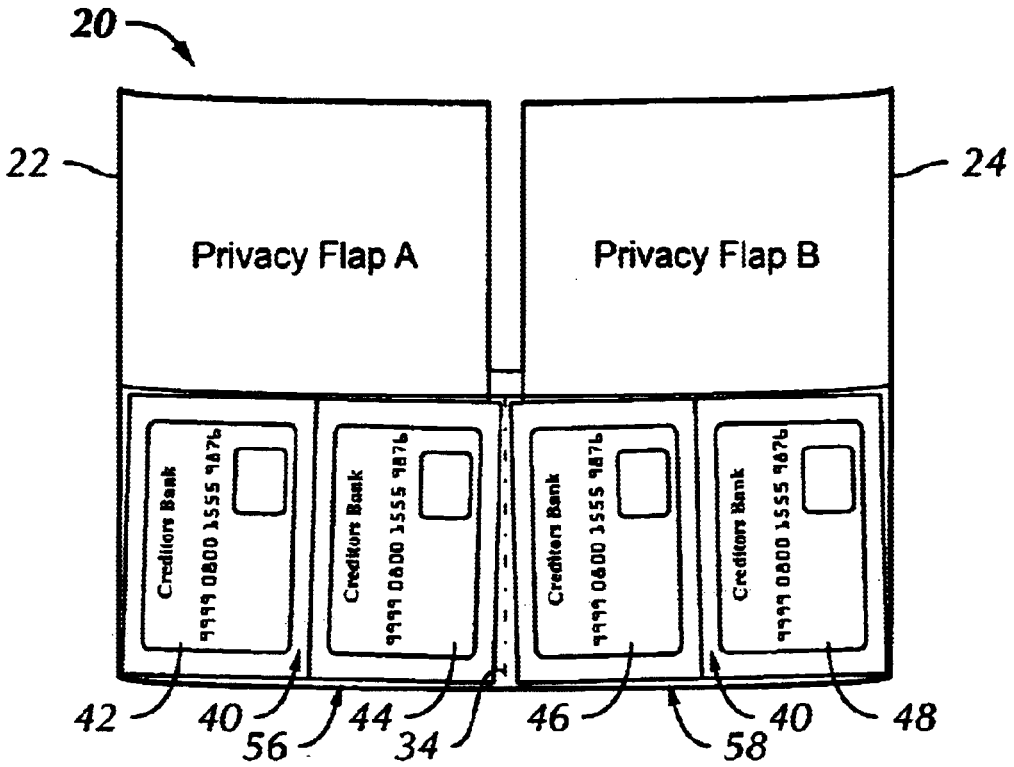
FIG. 2 is a front view of the wallet having an insert retaining a plurality of credit cards in the preferred embodiment of the present invention.

FIG. 2 is a front view of the wallet 20 having an insert 40 retaining a plurality of credit cards 42, 44, 46, and 48 in the preferred embodiment of the present invention. The privacy flaps 22 and 24 are shown in the open position. The insert is positioned within an opened wallet 20 and includes two pages 56 and 58. The insert is preferably constructed of a strong, yet flexible, material such as plastic. In the preferred embodiment of the present invention, four cards may be vertically aligned and placed side by side. The cards are configured to fit four adjacent to each other.

Figure 3:
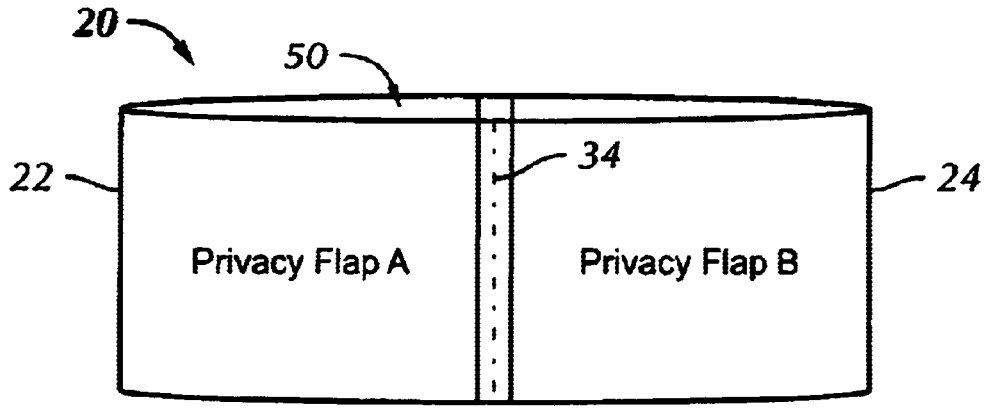
FIG. 3 is a front view of the wallet with the privacy flaps in the closed position.

FIG. 3 is a front view of the wallet 20 with the privacy flaps 22 and 24 in the closed position. The privacy flaps may be positioned downwardly to cover the contents of the wallet. The privacy flaps may be constructed of a material preventing viewing of the contents of the wallet. However, in an alternate embodiment of the present invention, one or both privacy flaps may be transparent. In the transparent embodiment, each flap may optionally be capable of holding photos or cards vertically or horizontally in a side by side photo album style configuration within pockets contained within the privacy flaps. In addition, the wallet may optionally include a lateral opening 50 for the retention of bills. The opening is large enough to accommodate large bills such as those found in European currency. When carrying the wallet 20, the wallet is folded along the center axis 34. As depicted, the wallet is open.

Figure 4:
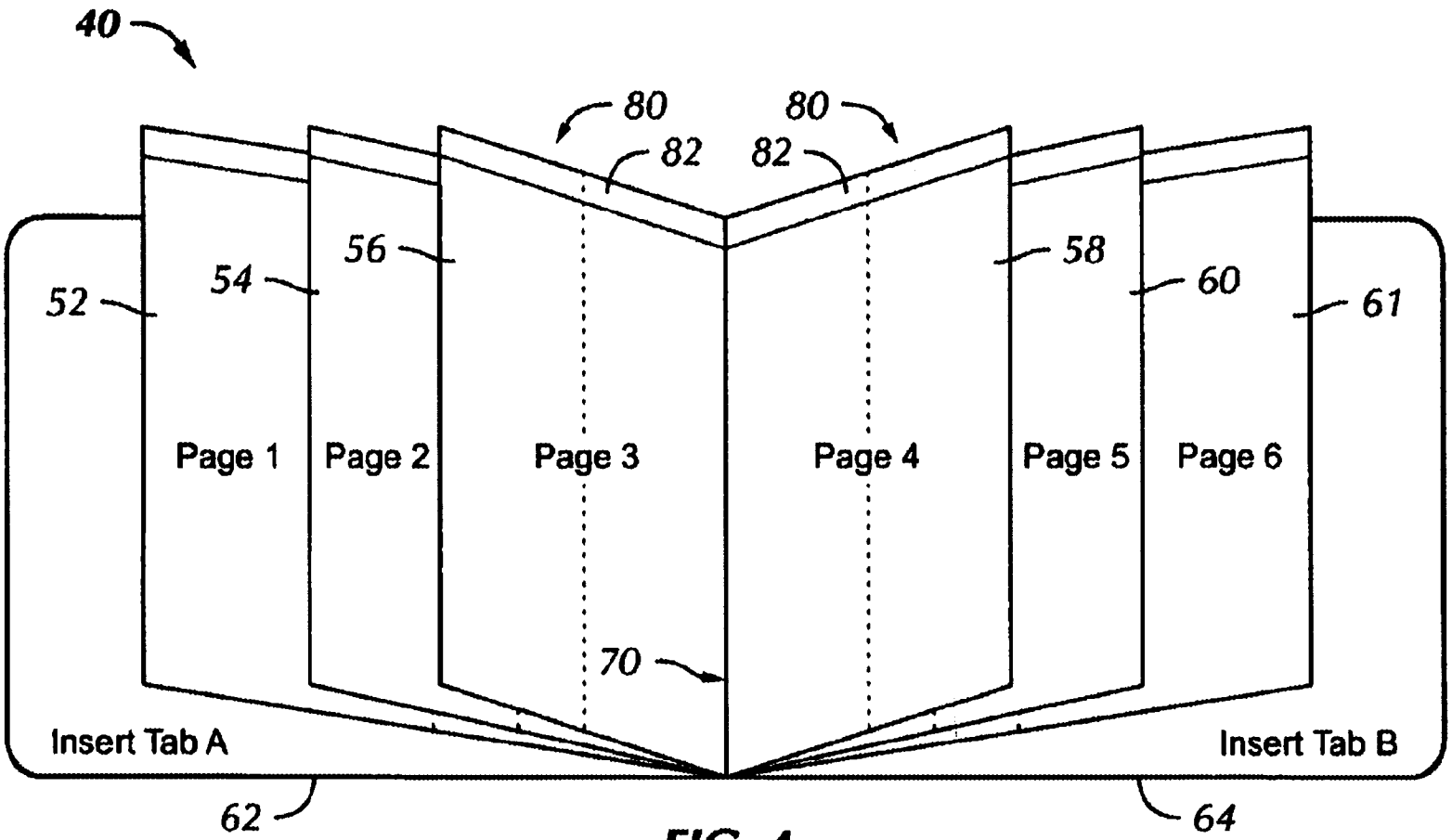
FIG. 4 is a front perspective view of the insert removed from the wallet.

FIG. 4 is a front perspective view of the insert 40 removed from the wallet 20. The insert includes a plurality of pages 52, 54, 56, 58, 60, and 61. In addition, the insert includes insert tabs 62 and 64. Preferably, the insert is configured to include a spine 70 from which the pages are held. However, in alternate embodiments of the present invention, the left aligned pages may be mounted separately from the right aligned pages. The insert tabs are constructed of a durable material and are inserted within the slit openings 30 and 32 (FIG. 1). The insert tabs may be constructed from a single sheet of material which is durable yet bends easily to allow the tabs to be inserted into the wallet. Alternatively, the tabs maybe he hinged about the centerline of the insert and operating a closed/opened book-like configuration.

The pages are configured in photo album style (pages with adjacently oriented cards on each page), with each card vertically aligned and laying side by side. Thus, in the preferred embodiment of the present invention, when the insert is in the open position depicted in FIG. 4, two opened pages hold four cards positioned next to each other. The pages are folded about the spine 70. The pages are sized and shaped to hold cards in the vertically aligned position. Thus, in the preferred embodiment of the present invention, the insert (in the open position) is ten inches wide and 4 inches tall. However, in alternate embodiments, the insert may be any size and shape to accommodate a plurality of cards. In such a preferred configuration, the tabs are slightly smaller (e.g. 3.5 inches) to allow accommodation within the slit openings. Additionally, although six pages are illustrated in FIG. 4, any number of pages may be utilized ranging from only one page to any plurality of pages.

The insert is constructed of a durable material (preferably water resistant), such as plastic. At an upper portion 80 of the insert is located radiused edges 82 (approximately ¼ of an inch) to allow for easier removal and insertion of a card within the insert. The cards may also be aligned singularly in each pocket (two cards on one page) of the page or back to back (four cards on one page).

Figure 5:
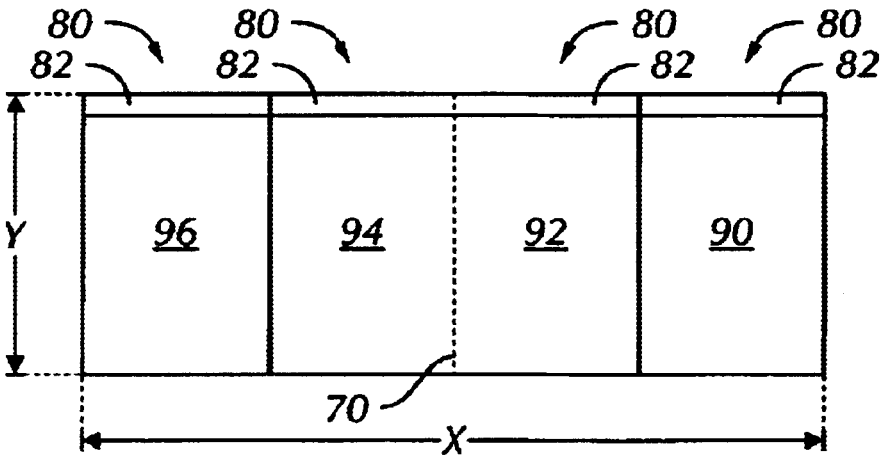
FIG. 5 is a front view of the insert removed from the wallet.

FIG. 5 is a front view of the insert 40 removed from the wallet 20. The insert includes a plurality of pockets 90, 92, 94, and 96 (preferably four side by side). At the top of each pocket is located the radiused edges 82. The pockets are used to hold cards (e.g., credit cards, identification, etc.) within its interior. As illustrated, the insert is a single piece of material attached at the spine 70. But as discussed above, the insert may be one or more pieces which are attached to the wallet. To accommodate conventional credit cards, the overall length X is approximately ten inches and the width Y is approximately four inches. However, it should be understood, that the size of the insert and the wallet may be any size to accommodate the carriage of a plurality of cards.

With reference to FIGS. 1–5, the operation of the wallet 20 will now be explained. The wallet is utilized for the carriage of a plurality of cards, such as credit cards, driver's license, social security cards, grocery store cards and promotional cards. As depicted in FIG. 1, the wallet is opened, with the privacy flaps 22 and 24 in the open position. The insert 40 is positioned within the wallet by positioning each inset tab 62 and 64 within the corresponding slit opening 30 and 32. The insert is held in position within the wallet by the insert tabs. Cards may be positioned within the pockets 90, 92, 94, and 96. The privacy flaps may be positioned over the cards. The wallet may then be folded about the center axis 34.

When in the closed position, the wallet is compact and provides a thin profile. The wallet enables a person to hold cards vertically in a side by side configuration. The insert is preferably provided in the photo album fashion, thus removing any excess space wasted by needless overlapping of the cards. The wallet provides maximum visibility and ease of access of the cards, with a minimum of thickness of the closed wallet. In the preferred embodiment of the present invention, the insert is removable. Since the insert is the major component which becomes worn, it may be easily replaced while still retaining the wallet, thereby reducing any costs associated with replacing the entire wallet by the user. The wallet also enables a person to carry photographs in a fashion which is easily visible while providing protection to the entire photograph. When utilizing privacy flaps with transparent pockets, photographs or identification may be positioned to be outwardly visible from one or more of the privacy flaps. With the wallet's thin profile, a person may comfortably position the wallet within the person's back pocket. Additionally, the wallet includes a lateral opening which accommodates larger bills, such as may be used in Europe.

Figure 6:
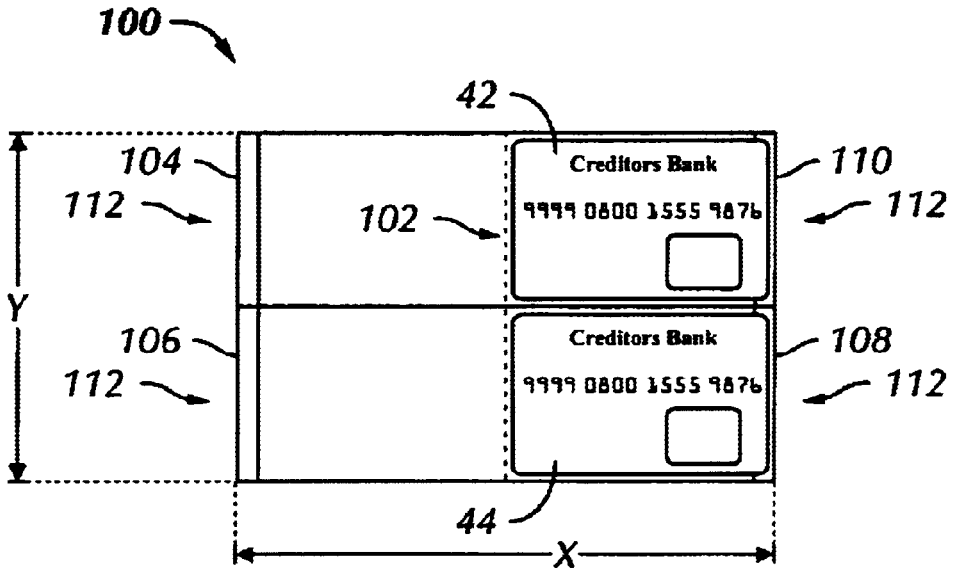
FIG. 6 is a front view of an insert in an alternate embodiment of the present invention.

FIG. 6 is a front view of an insert 100 in an alternate embodiment of the present invention. The credit cards 42 and 44 may be aligned horizontally, one above the other. In such a configuration, the insert is folded about the center axis 102. In addition, upon the side of each pocket 104, 106, 108, and 110 is a radiused edge 112. Cards may be inserted in one or more of the pockets 104, 106, 108, and 110. As illustrated in FIG. 6, cards are positioned within pockets 108 and 110. The radiused edge provides the same functionality as described for the radiused edge 82 for the insert 40. As configured in FIG. 6, the insert has an approximate length of 8 inches (X axis) and 5 inches in width (Y axis). However, as discussed above, the size of the insert and the wallet may vary to accommodate various sizes of cards. The insert 100 may include insert tabs (not shown) as described above for the insert 40. In addition, the wallet may be sized and shaped to accommodate the insert 100. The insert 100 may include a plurality of pages (not shown) in photo album fashion.

It is thus believed that the operation and construction of the present invention will be apparent from the foregoing description. While the device shown and described has been characterized as being preferred, it will be readily apparent that various changes and modifications could be made therein without departing from the scope of the invention as defined in the following claims.

What is claimed is:

1. A wallet for retaining a plurality of cards, said wallet comprising:

a bi-fold wallet case having a lateral opening running a substantial length of said wallet case, the lateral opening leading to an interior of said wallet case; and an insert affixed to said wallet case, said insert having a plurality of pages originating from a spine, each page having at least two pockets, each pocket-sized and shaped to retain at least one card, the cards on each page being aligned in a non-overlapping and adjacent configuration, the plurality of pages being arranged in photo album fashion;

a longest length of each card being aligned parallel to the spine when retained in the pocket;

whereby said insert retains a plurality of cards and said wallet case capable of retaining currency bills, said wallet case being sized to fit within a back pocket of a carrier of the wallet.

2. The wallet of claim 1 wherein said insert is permanently affixed to said wallet case.

3. The wallet of claim 1 wherein said insert is detachably affixed to said wallet case.

4. The wallet of claim 1 wherein said insert includes at least one insert tab and said wallet case includes a slit opening, whereby the insert tab is positioned within the slit opening of said wallet case to retain said insert within said wallet case.

5. The wallet of claim 1 wherein said wallet case includes at least one privacy flap, the privacy flap covering at least one page in a closed configuration.

6. The wallet of claim 5 wherein at least one privacy flap is transparent.

7. The wallet of claim 6 wherein the privacy flap includes at least one pocket having a transparent cover.

8. The wallet of claim 1 wherein said insert is two separate inserts, each insert being detachably affixed to said wallet case.

9. The wallet of claim 1 wherein said insert includes a first insert tab and a second insert tab and said wallet case includes a first slit opening and a second slit opening, whereby the first insert tab is positioned within the first slit opening and the second insert tab is positioned within the second slit opening to allow the insert to be detachably affixed to the wallet case.

10. The wallet of claim 1 wherein the pockets are configured to hold cards in a substantially vertical orientation.

11. The wallet of claim 1 wherein each pocket includes a slitted opening at a top portion of the pocket, whereby a card is inserted or removed through the slitted opening.

12. The wallet of claim 1 further comprising at least one privacy flap attached to the wallet case, the privacy flap fully covering one page when the wallet is opened to prevent viewing of cards held in pockets on the page underneath the privacy flap.

13. The wallet of claim 1 further comprising at least one privacy flap attached to the wallet case, the privacy flap fully covering one page when the wallet is opened to prevent viewing of cards held in pockets on the page underneath the privacy flap; and wherein each pocket includes a slitted opening at a top portion of the pocket, whereby a card is inserted or removed through the slitted opening.

14. A wallet for retaining a plurality of cards, said wallet comprising:

a bi-fold wallet case having a slit opening, said wallet case being sized to fit within a back pocket of a carrier of the wallet; and a detachable insert affixed to said wallet case, said insert having:

a plurality of pages originating from a spine, each page having at least two pockets, each pocket sized and shaped to retain at least one card;

the pockets being configured to hold cards in a substantially vertical orientation, the cards on each page being aligned in a non-overlapping and adjacent configuration;

the plurality of pages being arranged in photo album fashion;

a longest length of each card being aligned parallel to the spine when retained in the pocket; and at least one insert tab, the insert tab being positioned within the slit opening of said wallet case to retain said insert within said wallet case;

whereby said insert retains a plurality of cards.

15. The wallet of claim 14 wherein the wallet case includes a lateral opening running a substantial length of said wallet case, the lateral opening leading to an interior of said wallet case, whereby said wallet case is capable of retaining currency bills.

16. The wallet of claim 14 wherein the pockets are arranged with two or more pockets being aligned on each page to configure the plurality of pages in photo album fashion.

17. The wallet of claim 14 wherein said insert further comprises a second insert tab and said wallet case includes a second slit opening, whereby the second insert tab is positioned within the second slit opening to allow the insert to be detachably affixed to the wallet case.

18. The wallet of claim 14 wherein said wallet case includes at least one privacy flap for covering at least a portion of said insert.

19. A wallet for retaining a plurality of cards, said wallet comprising:

a bi-fold wallet case having a lateral opening running a substantial length of said wallet case, the lateral opening leading to an interior of said wallet case, and said wallet case having a slit opening, said wallet case being sized to fit within a back pocket of a carrier of the wallet; and a detachable insert affixed to said wallet case, said insert having:

a plurality of pages originating from a spine, each page having at least two pockets, each pocket sized and shaped to retain at least one card;

the pockets being configured to hold cards, the cards on each page being aligned in a non-overlapping and adjacent configuration;

the plurality of pages being arranged in photo album fashion;

a longest length of each card being aligned parallel to the spine when retained in the pocket; and at least one insert tab, the insert tab being positioned within the slit opening of said wallet case to retain said insert within said wallet case;

whereby said insert retains a plurality of cards and said wallet case capable of retaining currency bills.

20. The wallet of claim 19 wherein the packets are arranged with two or more pockets being aligned on each page to configure the plurality of pages in photo album fashion.

21. The wallet of claim 19 wherein said insert further comprises a second insert tab and said wallet case includes a second slit opening, whereby the second insert tab is positioned within the second slit opening to allow the insert to be detachably affixed to the wallet case.

22. The wallet of claim 19 wherein said wallet case includes at least one privacy flap for covering at least a portion of said insert.

* * * * *